United States Patent [19]

Hemmer et al.

[11] Patent Number: 4,728,301

[45] Date of Patent: Mar. 1, 1988

[54] PIN/SOCKET, PIN/PIN TRIAXIAL INTERFACE CONTACT ASSEMBLY

[75] Inventors: Valentine J. Hemmer, Unadilla; Lloyd G. Ratchford, Oneonta, both of N.Y.

[73] Assignee: Amphenol Corporation, Wallingford, Conn.

[21] Appl. No.: 49,742

[22] Filed: May 14, 1987

[51] Int. Cl.[4] ..... H01R 17/18

[52] U.S. Cl. ..... 439/578; 439/585; 439/675

[58] Field of Search ..... 439/578, 579, 580, 581, 439/582, 583, 584, 585, 675, 877, 878, 880, 882, 638, 641, 645

[56] References Cited

U.S. PATENT DOCUMENTS

| | | | |
|---|---|---|---|
| 2,901,528 | 8/1959 | Lazar | 439/730 |
| 3,510,829 | 5/1970 | Keller | 439/585 |
| 3,539,976 | 11/1970 | Reynolds | 439/585 |
| 3,923,367 | 12/1975 | Carter | 439/585 |
| 4,307,926 | 12/1981 | Smith | 439/610 |
| 4,509,816 | 4/1985 | Freitag | 439/585 |

FOREIGN PATENT DOCUMENTS

| | | | |
|---|---|---|---|
| 2006553 | 12/1969 | France | 439/669 |

*Primary Examiner*—Gil Weidenfeld
*Assistant Examiner*—David Pirlot
*Attorney, Agent, or Firm*—Bacon & Thomas

[57] ABSTRACT

A pin/socket, pin/pin triaxial interface contact assembly is disclosed which features a minimum number of contacts and insulators which are metal staked to form a contact assembly for mating with concentric twinaxial or triaxial contacts. The assembly is cost effective and withstands significantly high temperatures without degrading the assembly or the positioning of the several components thereof as would otherwise be the case.

11 Claims, 2 Drawing Figures

PIN/SOCKET, PIN/PIN TRIAXIAL INTERFACE CONTACT ASSEMBLY

BACKGROUND OF THE INVENTION

This invention relates to pin/socket, pin/pin triaxial interface contact assemblies for mating with concentric twinaxial or triaxial contacts.

Prior to the present invention, interface contact assemblies of the type described were made of a multiplicity of components and an epoxy adhesive, or were of a single metal staked assembly. No means were provided to control the adverse tolerance build up between components. Furthermore, the contact assemblies were complex as, for example, the intermediate contact being of two pieces and requiring double ended socket and pin components, and hence were not cost effective.

The present invention overcomes these disadvantages by providing a contact assembly having a minimum number of components and features metal staking for affixing the several components of the assembly to each other.

SUMMARY OF THE INVENTION

This invention contemplates an interface contact of the type described including an inner contact, an intermediate contact and an inner insulator disposed in concentric relation to each other. The intermediate contact is metal staked on an outer diameter undercut. The staking forms a portion of the intermediate contact inner diameter which compresses the inner insulator into ring grooves on the inner contact outer diameter to provide an initial assembly. The interface contact further includes an outer insulator and an outer contact disposed in concentric relation to the inner contact, inner insulator and intermediate contact of the initial assembly. The outer contact is staked to form a portion of the outer contact internal diameter which compresses the outer insulator into a grooved portion of the intermediate contact to provide a final assembly.

Accordingly, this invention discloses and claims an interface contact assembly comprising: an inner contact; an inner insulator concentrically surrounding the inner contact; an intermediate contact concentrically surrounding the inner insulator; first means arranged with the intermediate contact and the inner contact so that when the intermediate contact is staked the inner insulator is compressed into the inner contact to provide an initial assembly; an outer insulator concentrically surrounding the intermediate contact; an outer contact concentrically surrounding the outer insulator; and second means arranged with the intermediate contact so that when the outer contact is staked the outer insulator is compressed into the intermediate contact to provide a final assembly.

DETAILED DESCRIPTION OF THE INVENTION

Figure 1:
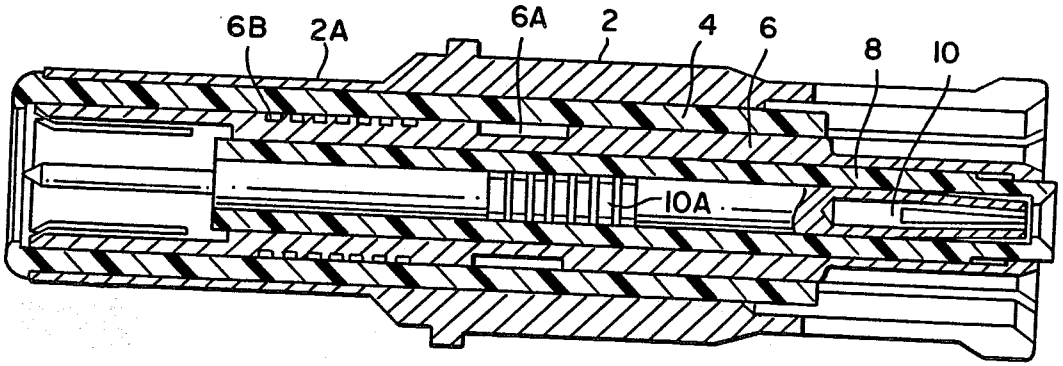
FIG. 1 is a longitudinal sectional view of a pin/socket contact assembly according to the invention.

With reference to FIG. 1, a pin/socket interface contact assembly includes an outer contact 2 surrounding an outer insulator 4, an intermediate contact 6 surrounded by outer insulator 4, an inner insulator 8 surrounded by intermediate contact 6 and an inner pin/socket contact 10 surrounded by inner insulator 8.

Inner contact 10, inner insulator 8 and intermediate contact 6 are disposed in concentric relation to each other as by suitable fixturing or the like. Intermediate contact 6 is metal staked at an undercut 6A on its outer diameter. This staking forms a portion of the intermediate contact inner diameter which compresses inner insulator 8, which is of a suitable dielectric material, into ring grooves 10A on the outer diameter of inner contact 10 in the area of undercut 6A to provide an initial staked assembly.

Outer insulator 4 and outer contact 2 are disposed in concentric relation relative to the initial staked assembly including inner contact 10, inner insulator 8 and intermediate contact 6 as by suitable fixturing or the like. Outer contact 2 is staked at its pin end as at 2A and forms a portion of the outer contact pin end inner diameter which compresses outer insulator 4, which is of a suitable dielectric material, into grooves 6B on the outer diameter of intermediate contact 6 in the area of the stake to provide a final staked assembly.

Figure 2:
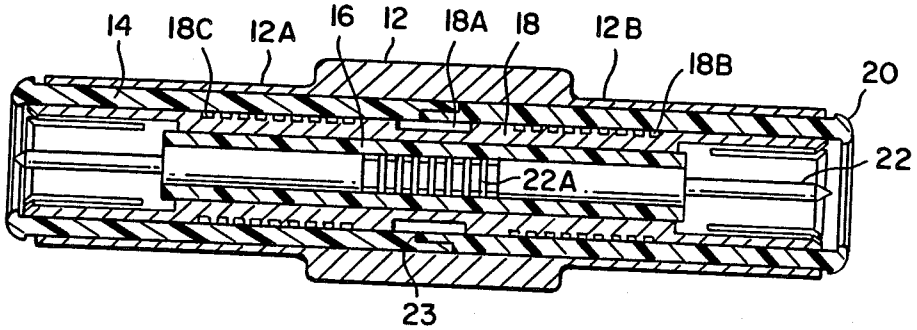
FIG. 2 is a longitudinal sectional view of a pin/pin contact assembly according to the invention.

With reference to FIG. 2, a pin/pin interface contact assembly includes an outer contact 12 surrounding an outer insulator 14 and an outer insulator 20, an intermediate contact 18 surrounded by insulators 14 and 20, an inner insulator 16 surrounded by intermediate contact 18 and an inner pin/pin contact 22 surrounded by inner insulator 16.

Inner contact 22, inner insulator 16 and intermediate contact 18 are disposed in concentric relation to each other as by suitable fixturing or the like. Intermediate contact 18 is metal staked at an undercut 18A on its outer diameter. This staking forms a portion of the intermediate contact inner diameter which compresses inner insulator 16, which is of a suitable dielectric material, into ring grooves 22A on the outer diameter of contact 22 in the area of undercut 18A to provide an initial staked assembly.

Outer insulator 14, outer contact 12 and outer insulator 20 are disposed in concentric relation relative to the initial staked assembly including inner contact 22, inner insulator 16 and intermediate contact 18 as by suitable fixturing or the like. Outer contact 12 is staked at both of its ends as at 12A and 12B and forms portions of the outer contact inner diameter which compress outer insulator 14 and outer insulator 20, which are of a suitable dielectric material, into grooves 18B and 18C, respectively, on the outer diameter of intermediate contact 18 in the areas of the stakes to provide a final staked assembly.

As will be seen with reference to FIG. 2, the pin/pin contact assembly features two outer insulators 14 and 20 which abut each other as at 23 to provide a continuous outer insulator arrangement. Thus, for the staking to be effective, outer contact 12 is staked at two places 12A and 12B as heretofore described.

In regard to the several insulators shown and described, it will be understood that they may be machined or molded from a material such as Torlon or Ultem 1000, and will permit some distortion so as to be compressed into the several grooves and rings 6B, 10A, 18A, 18B and 22A, without cracking, and thus provide an effective staked assembly for the purposes described.

It has been found that an assembly in accordance with the aforegoing will withstand temperatures up to 200°

C. without degradation of the assembly or the position of the several components thereof.

With the aforenoted description of the invention in mind reference is made to the claims appended hereto for a definition of the scope of the invention.

What is claimed is:

1. An interface contact assembly comprising:
an inner contact;
an inner insulator concentrically surrounding the inner contact;
an intermediate contact concentrically surrounding the inner insulator;
first means arranged with the intermediate contact and the inner contact so that when the intermediate contact is staked the inner insulator is compressed into the inner contact to provide an initial assembly;
an outer insulator concentrically surrounding the intermediate contact;
an outer contact concentrically surrounding the outer insulator; and
second means arranged with the intermediate insulator so that when the outer contact is staked the outer insulator is compressed into the intermediate contact to provide a final assembly.

2. An interface contact assembly as described by claim 1, wherein the first means includes:
the intermediate contact having an outer diameter with an undercut thereon and an inner diameter;
the inner contact having an outer diameter with ring grooves thereon in the area of the undercut; and
the intermediate contact being staked in the undercut, whereupon a portion of the intermediate contact inner diameter compresses the inner insulator into the inner contact ring grooves to provide the initial assembly.

3. An interface contact assembly as described by claim 1, wherein the second means includes:
grooves on at least one end of the outer diameter of the intermediate contact so that when the outer contact is staked in the area of said grooves at least one portion of the outer contact compresses the outer insulator into said grooves to provide the final assembly.

4. An interface contact as described by claim 1, wherein:
the inner contact is a pin/socket contact.

5. An interface contact as described by claim 1, wherein:
the inner contact is a pin/pin contact.

6. An interface contact assembly, comprising:
an outer contact having inner and outer diameters;
an outer insulator surrounded by the outer contact;
an intermediate contact surrounded by the outer insulator and having inner and outer diameters;
an inner insulator surrounded by the intermediate contact;
an inner contact, surrounded by the inner insulator and having an outer diameter;
the inner contact, the inner insulator and the intermediate contact disposed in concentric relation to each other;
first means associated with the intermediate contact and the inner contact so that when the intermediate contact is staked a portion of the inner diameter thereof compresses the inner insulator into the inner contact to provide an initial assembly;
the outer insulator and the outer contact being disposed in concentric relation to the initial assembly; and
second means associated with the intermediate contact so that when the outer contact is staked a portion of the inner diameter thereof compresses the outer insulator into the intermediate contact to provide a final assembly.

7. An interface contact assembly as described by claim 6, wherein the first means includes:
an undercut on the outer diameter of the intermediate contact;
ring grooves disposed on the outer diameter of the inner contact within the area of the undercut;
the intermediate contact being staked at the undercut, whereupon a portion of the inner diameter of the intermediate contact compresses the inner insulator into the inner contact ring grooves to provide the initial assembly.

8. An interface contact assembly as described by claim 6, wherein the second means includes:
grooves on at least one end of the intermediate contact so that when the outer contact is staked in the area of the grooves a portion of its inner diameter compresses the outer insulator into said grooves to provide the final assembly.

9. An interface contact assembly as described by claim 8, wherein:
the outer insulator includes a first member extending to one end of the outer contact and a second member extending to the opposite end thereof;
said first and second members abutting each other to form a continuous outer insulator;
the grooves are at one end of the intermediate contact and at the opposite end thereof; and
the outer contact is staked at its one and opposite ends in the respective areas of the grooves at the one end and the opposite ends of the intermediate contact so that corresponding portions of the inner diameter of the outer contact compress the first and the second outer insulator members into corresponding grooves to provide the final assembly.

10. An interface contact assembly, comprising:
an outer contact having inner and outer diameters;
an outer insulator surrounded by the outer contact;
an intermediate contact surrounded by the outer insulator and having inner and outer diameters, and having an undercut on one section of its outer diameter and grooves on at least one end thereof;
an inner insulator surrounded by the intermediate contact;
an inner contact surrounded by the inner insulator, and having an outer diameter and ring grooves on said outer diameter;
the inner contact, the inner insulator and the intermediate contact disposed in concentric relation to each other;
the intermediate contact being staked at its undercut in the area of the inner contact ring grooves, whereby a portion of the inner diameter thereof compresses the inner insulator into said ring grooves to provide an initial assembly;
the outer insulator and outer contact disposed in concentric relation to the initial assembly; and
the outer contact being staked on its outer diameter in the area of the intermediate contact grooves, so that a portion of its inner diameter compresses the outer insulator into said grooves to provide the final assembly.

11. An interface contact as described by claim 10, wherein:
the inner and outer insulators are of a material which permits compression of said insulators into the grooves and ring grooves, respectively.

* * * * *